US005586901A

United States Patent [19]

Muta

[11] Patent Number: 5,586,901

[45] Date of Patent: Dec. 24, 1996

[54] CONNECTOR ASSEMBLY WITH COOPERATING TERMINALS AND METHOD FOR CONNECTING SAME

[75] Inventor: Junji Muta, Yokkaichi, Japan

[73] Assignee: Sumitomo Wiring Systems, Ltd., Mie, Japan

[21] Appl. No.: 565,579

[22] Filed: Nov. 30, 1995

[30] Foreign Application Priority Data

Dec. 7, 1994 [JP] Japan ..... 6-331121

[51] Int. Cl.[6] ..... H01R 13/64

[52] U.S. Cl. ..... 439/342; 439/376

[58] Field of Search ..... 439/374, 342, 439/376

[56] References Cited

FOREIGN PATENT DOCUMENTS 4-80258 7/1992 Japan .

*Primary Examiner*—Gary F. Paumen
*Assistant Examiner*—T. C. Patel
*Attorney, Agent, or Firm*—Oliff & Berridge

[57] ABSTRACT

A connector having male and female terminals can be positively connected together without requiring alignment precision on the part of the housing for the terminals. A male terminal has a round stem with a large diameter proximal end portion and a small diameter distal end portion. A female terminal has a connection portion formed on a triangular horizontal cross-section and a pair of holding plate portions extending from a base plate portion. The connection portion can resiliently fit on an outer periphery of the large diameter portion. An insertion groove, which is slightly smaller than the diameter of the small diameter portion, is formed between front ends of the two holding plate portions. A pair of outwardly-opening guide plate portions are formed on opposite edges of the insertion groove so the female terminal can be fitted on the round stem and the small diameter portion is guided by the guide plate portions to fit in the insertion groove. The female and male terminals are thus positioned with respect to each other. When the female terminal is pushed further, the small diameter portion passes through the insertion groove. The female terminal is pushed downwardly so the connection portion fits on the outer periphery of the large diameter portion.

25 Claims, 5 Drawing Sheets

CONNECTOR ASSEMBLY WITH COOPERATING TERMINALS AND METHOD FOR CONNECTING SAME

BACKGROUND OF THE INVENTION

1. Field of the Invention

This invention relates to a connector assembly. In particular, the connector assembly includes female and male terminals that have an improved cooperating fitting portion structure. The invention also relates to a method that facilitates connecting the male and female terminals together.

2. Background of Related Art

Connector assemblies for direct connection to a motor include male and female connectors. Each male connector includes a male terminal having a tab portion that projects from a housing directly mounted on the motor. Each female connector includes a female terminal that mates with and fits on the male connector. The female connector usually fits on the male connector from the side that the tab portion extends. However, mounting legs for mounting the housing on a body may project in front of the tab portion. Therefore, the mounting space is limited, so the connection of the female and male connectors is difficult and must be accomplished with wiggling or shaking the male and female connectors with respect to each other.

To overcome the above noted problem, it has been proposed, such as in Japanese Utility Model Unexamined Publication No. 4-80258, to provide a female connector initially disposed on a lateral side of a male connector. The female connector is then fit to the male connector from the lateral side. However, if a tab portion of the male terminal projects at an angle, or the female terminal is not received in a housing, incomplete alignment may result and the male and female terminals cannot be properly fit together. In order to overcome such incomplete alignment, it is possible to provide the connection portion of the female terminal with a flaring guide portion to guide the tab portion of the male terminal. However, in order to deal with a wide range of incomplete alignments, the flaring guide portion must be considerably larger than the thickness of the tab portion. This construction is hard to obtain. Therefore, the alignment of the housing must be made more exacting, for example, by precise mounting of the male and female terminals on their respective housings. Further, the required precise fitting of the male and female connectors results in increased manufacturing costs, which is undesirable.

Moreover, this disadvantage is encountered not only with a connector for direct connection to a motor, but also for general type connectors, where male and female terminals in their respective housings are connected together.

SUMMARY OF THE INVENTION

The connector assembly according to this invention overcomes the above noted problems. One object of this invention is to provide a connector assembly where male and female terminals can be positively connected together, without requiring precise alignment of connector housings.

According to one embodiment of the invention, a connector assembly includes engageable male and female connectors. Male and female terminals are mounted on a pair of female and male housings of the respective connectors. The male and female terminals are formed from a conductive material, for example, a metal. The male terminal includes a distal end portion that is narrower than its proximal end portion. The female terminal includes a connection portion that resiliently fits onto an outer periphery of the proximal end portion of the male terminal, and an insertion groove is formed in a side surface of the connection portion. The insertion groove is configured to hold the narrower distal end portion of the male terminal and allows the narrower distal end portion to pass through into the connection portion. The female terminal also includes guide portions for guiding the narrower distal end portion of the male terminal into the insertion groove. The guide portions are formed on opposite side edges of the insertion groove.

The female terminal is first moved from a direction, which intersects an axis of the male terminal, toward the male terminal with the narrower distal end portion of the male terminal passing through the insertion groove. The female terminal is then moved along the axis of the male terminal to complete connection between the male and female terminals and thus the connectors.

The method of connecting the male housing to a female housing includes guiding the female terminal initially in a first direction into engagement with the distal end of the at least one male terminal and guiding the at least one female terminal in a second direction that is different than the first direction axially along the at least one male terminal until the at least one female terminal engages the proximal end.

Further, the connector assembly can comprise a male housing, which has at least one male terminal with a proximal end and a distal end that is narrower than the proximal end and a female housing, engageable with the male housing, which includes at least one female terminal electrically engageable with the at least one male terminal. Further, a first structure of the connector assembly capable of guiding in a first direction the at least one female terminal initially into engagement with the distal end of the at least one male terminal. A second structure capable of guiding the at least one female terminal in a second direction that is different than the first direction axially along the at least one male terminal until the at least one female terminal engages the proximal end.

Other objects, advantages and salient features of the invention will become apparent from the following detailed description, which, taken in conjunction with the annexed drawings, discloses preferred embodiments of the invention.

BRIEF DESCRIPTION OF DRAWINGS

The invention will be described in detail with reference to the following drawings in which like reference numerals refer to like elements and wherein.

DETAILED DESCRIPTION OF PREFERRED EMBODIMENTS

Figure 1:
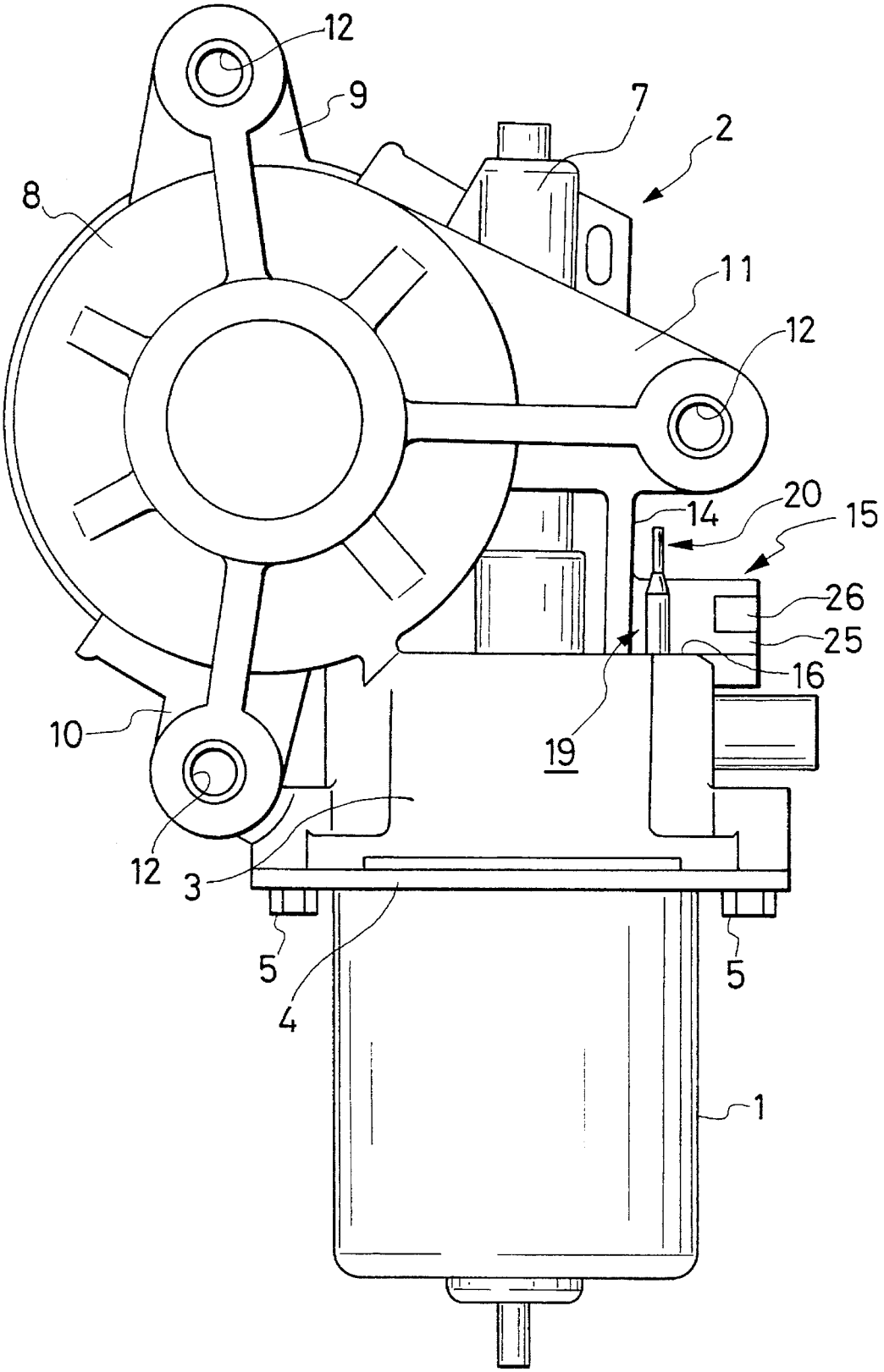
FIG. 1 is a front-elevational view of one preferred embodiment of a connector connected directly to a motor.

In FIG. 1, a housing 2 is mounted on one end of a motor 1, from which a motor output shaft (not shown) projects. The housing 2 is molded with a unitary construction from a synthetic resin. The housing 2 includes a mounting portion 3 that mates with and is fastened to a mounting flange 4 of the motor 1 by a connector, for example, screws 5. The mounting portion 3 covers the mounting-side end of the motor 1.

The housing 2 has an output shaft-receiving portion 7 in which the output shaft of the motor 1 is rotatably received. The output shaft-receiving portion 7 is in communication with the mounting portion 3. A gear receiving portion 8 is formed on one side of the output shaft-receiving portion 7. A gear (not shown) is preferably meshed with a worm gear (not shown) formed on the output shaft and is rotatably received in the gear receiving portion 8.

Three mounting legs 9–11 are formed at intervals on the outer periphery of the gear receiving portion 8 and extend therefrom. Two of the mounting legs 9 and 10 are formed generally at the top and bottom of the gear mounting portion 8. The other mounting leg 11 extends away from the gear receiving portion 8 in an intersecting relationship to the output shaft-receiving portion 7. A mounting hole 12 is formed through a distal end of each of the mounting legs 9–11. The housing 2 can be fastened to a fixing member (not shown), such as a vehicle body or the like, by screws passing through the mounting holes 12.

Figure 2:
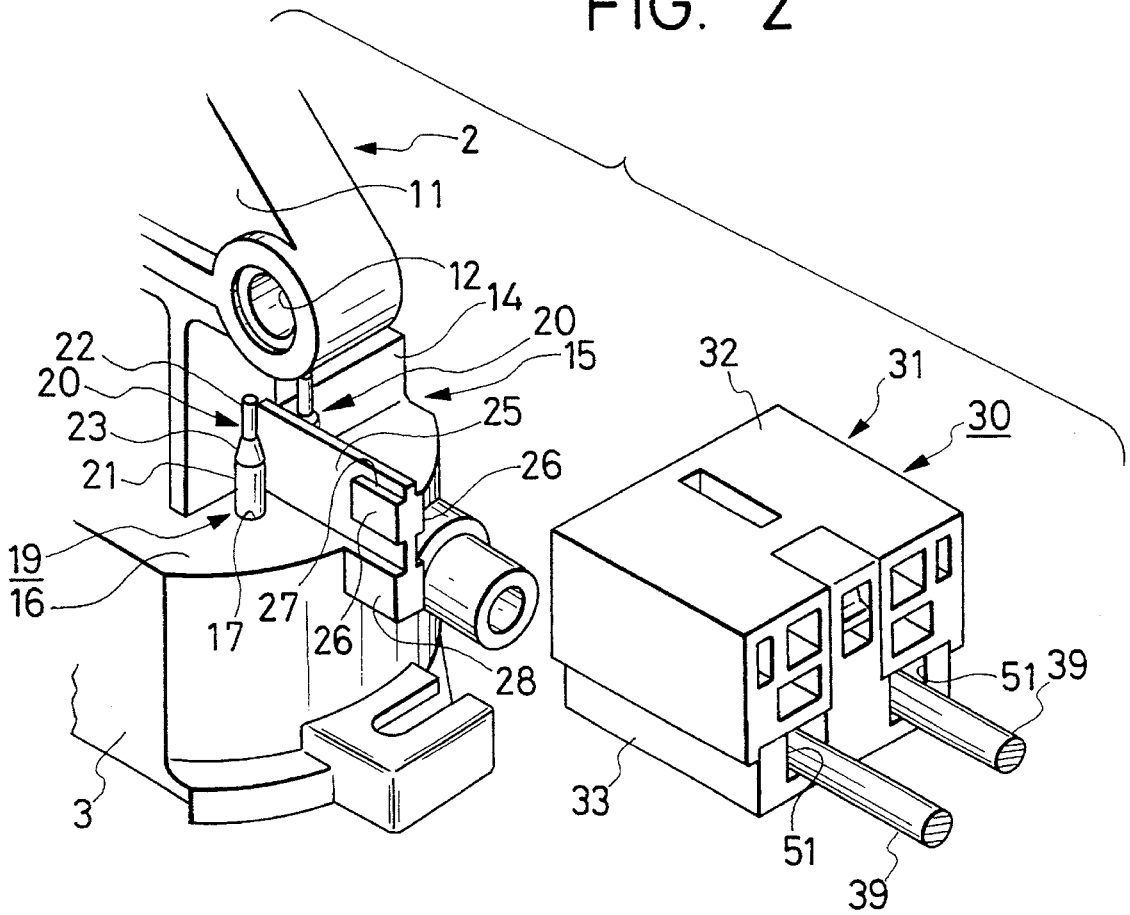
FIG. 2 is an exploded, perspective view showing fitting portions of male and female connectors.

An abutment wall 14 is formed between the lower surface of the mounting leg 11 and the upper surface of the mounting portion 3. The abutment wall 14 is disposed adjacent to the output shaft-receiving portion 7 and extends in a parallel relationship thereto. A male connector 15 is formed at the outer side of the abutment wall 14. As shown in FIG. 2, two round holes 17 are formed on a bottom surface 16 of the male connector 15, defined by the upper surface of the mounting portion 3. The two round holes 17 are disposed adjacent to an outer surface of the abutment wall 14 and are spaced a predetermined distance from each other in a direction parallel to the abutment wall 14.

A pair of male terminals 19 are connected to a brush (not shown) of the motor 1 and are provided on the bottom surface 16 of the male connector 15. The male terminals are formed from a conductive material, for example, metal. The male terminals 19 include a round stem 20 that projects upwardly through hole 17 for a predetermined distance above the bottom surface 16. As shown in detail in FIG. 4, the stem 20 has a large diameter proximal end portion 21, which is snugly fit in the hole 17 and a small diameter distal end portion 22. A tapering portion 23 interconnects the small diameter portion 22 and the large diameter portion 21.

A guide plate 25 is integrally formed on the bottom surface 16 and is disposed intermediate the two round stems 20 of the male connector 15. The guide plate 25 extends perpendicular to the abutment wall 14. The guide plate 25 extends upwardly to a height generally equal to the upper end of the tapering portion 23 of the round stem 20. The guide plate 25 projects outwardly a predetermined distance from the peripheral edge of the bottom surface 16. A pair of limitation portions 26 are formed respectively on opposite sides of the guide plate 25.

The limitation portions 26 each have a flat, rectangular parallelepipedic shape. The upper surface of the limitation portion 26 forms a sliding surface 27 that is parallel to the bottom surface 16 of the male connector 15. A bottom surface of a mating female connector 30 can be brought into sliding contact with the sliding surfaces 27, so the female connector 30 can be pushed parallel to the bottom surface 16 of the male connector 15.

Figure 4:
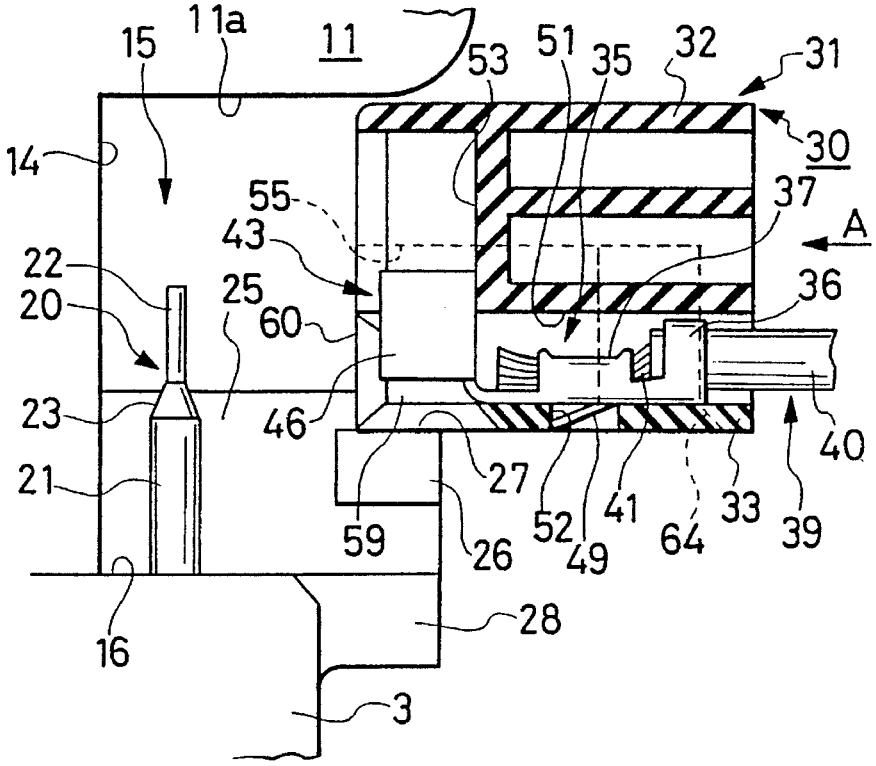
FIG. 4 is a vertical cross-sectional view showing an initial stage of fitting of the female connector.

The distance between the sliding surface 27 of each of the limitation portions 26 and a lower surface 11*a* of the mounting leg 11 is generally equal to the height of the female connector 30 (see FIG. 4). A reinforcing portion 28 is integrally formed on the lower surface of the guide plate 25 and projects outwardly from the peripheral edge of the bottom surface 16 of the male connector 15. The reinforcing portion 28 has a larger thickness then the guide plate 25 and extends from the outer peripheral surface of the mounting portion 3.

Figure 3:
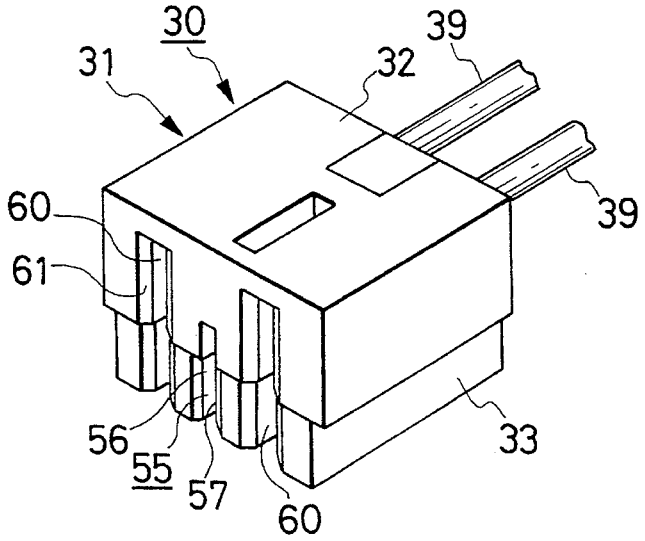
FIG. 3 is a perspective view of the female connector.
Figure 5:
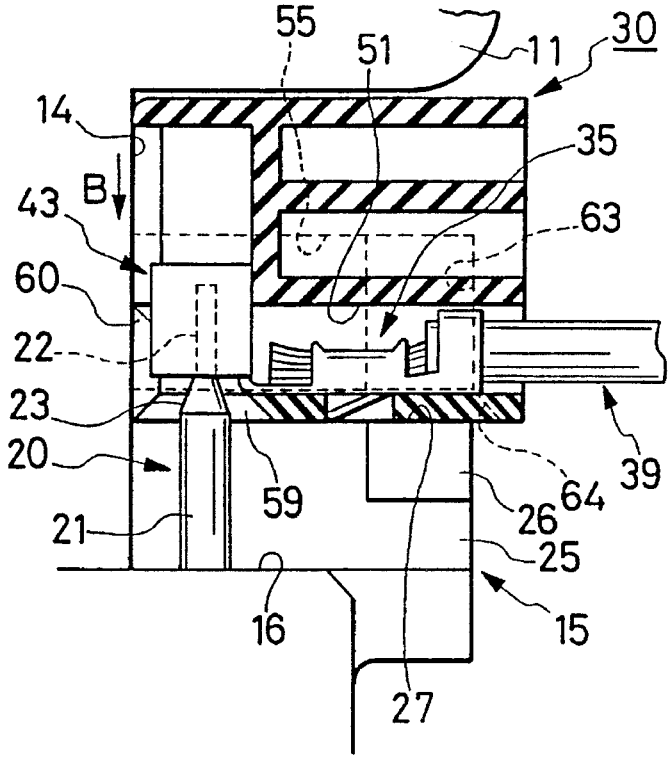
FIG. 5 is vertical cross-sectional view showing the female connector fit in a direction perpendicular to a round stem of the male terminal.

As seen in FIGS. 2 and 3, the female connector 30 includes a housing 31 formed from a synthetic resin. The female connector 30 comprises upper and lower housings 32 and 33, respectively, which fit together to form a housing unit having a generally rectangular parallelepipedic shape. The housing 31 has a height permitting it to be inserted between the sliding surfaces 27 of the limitation portions 26 and the lower surface 11*a* of the mounting leg 11. The housing 31 is slightly longer in length than the guide plate 25, as can be seen in FIG. 5. A pair of female terminals 35 can be received in the housing 31. The female terminals 35 are formed from a conductive material, for example, metal.

Each of the female terminals 35 is formed by pressing a metal sheet into a predetermined shape. The female terminals 35 have an insulation barrel 36 and a wire barrel 37 at its proximal portion, as shown in FIG. 4. An end portion of a sheath 40 of a wire 39 is clamped by the insulation barrel 36. A conductor 41 projects from the end of the sheath 40 of wire 39 and is clamped by the wire barrel 37, thus connecting the wire 39 to the female terminal 35.

Figure 7:
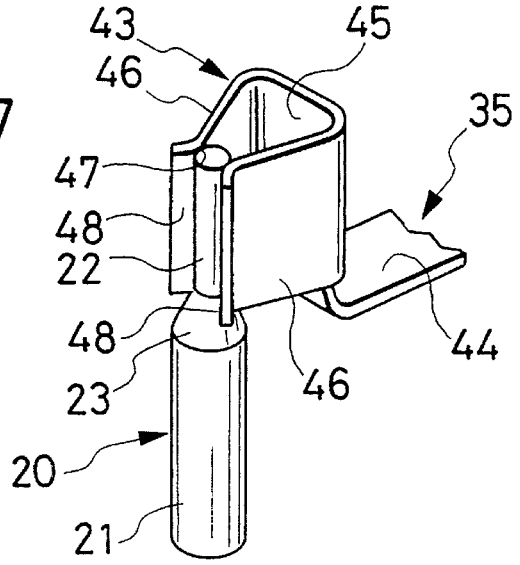
FIG. 7 is an enlarged perspective view showing female and male terminals.

Each female terminal 35 also includes a connection portion 43, which fits on the round stem 20 of the male terminal 19, formed at the distal end of the female terminal 35. As shown in FIG. 7, the connection portion 43 includes a base plate portion 45 that extends upwardly from a distal end of a bottom plate 44 and a pair of holding plate portions 46, each of which extends from opposite side edges of the base plate portion 45. The holding plate portions 46 converge toward their distal ends, so the connection portion 43 has a generally tubular shape with a generally triangular horizontal cross-section. Thus, the connection portion 43 can resiliently fit on the outer peripheral surface of the large diameter portion 21 of the round stem 20 of the male terminal 19.

Each female terminal 35 includes opposed distal ends of the two holding portions 46 that are spaced from each other a distance slightly smaller than the diameter of the smaller-diameter portion 22 of the round stem 20. An insertion groove 47 is formed between the opposed distal ends of the two holding portions 46. A pair of outwardly opening guide plate portions 48 are formed on opposite side edges of the insertion groove 47. Each female terminal 35 also includes a lance 49, as shown in FIG. 4, formed by stamping the bottom plate 44 of the female terminal 35.

A pair of terminal receiving chambers 51, which receive the female terminals 35, are formed in the housing 31 of the female connector 30. Each terminal receiving chamber 51 extends from a lower portion at a rear surface of the housing 31 (right surface in FIG. 4) to a position slightly short of a front surface thereof. Each terminal receiving chamber 51 then extends perpendicularly toward an upper surface of the housing 31, so the terminal receiving chamber 51 has a generally L-shaped cross-section.

The upper housing 32 can be detached from the lower housing 33 and each female terminal 35 can be brought into the lower housing 33 from its upper side. The lance 49 can be fit in a retaining hole 52 formed in the lower housing 33 and the upper housing 32 can be then re-attached to the lower housing 33 to fixedly hold each female terminal 35 in the associated terminal receiving chamber 51. The connection portion 43 of the female terminal 35 is thus received in a lower portion of a vertical receiving portion 53 of the terminal receiving chamber 51.

When the female connector 30 is placed on the sliding surfaces 27 of the limitation portions 26, as shown in FIG. 4, the insertion groove 47 is disposed at a height corresponding to the small diameter portion 22 of the round stem 20. Further, an upper portion of the vertical receiving portion 53 defines a space for insertion of the male terminal (to be described hereinafter).

A fitting groove 55, which snugly receives the guide plate 25 of the male connector 15, is formed in the housing 31 of the female connector 30. The fitting groove 55 is centrally disposed on the width of the housing 31 and is open to the front and bottom surfaces of the housing 31. The fitting groove 55 defines a front opening 56. Tapering guide surfaces 57 are formed respectively on opposite side edges of the front opening 56 of the fitting groove 55, as shown in FIG. 3.

Figure 6:
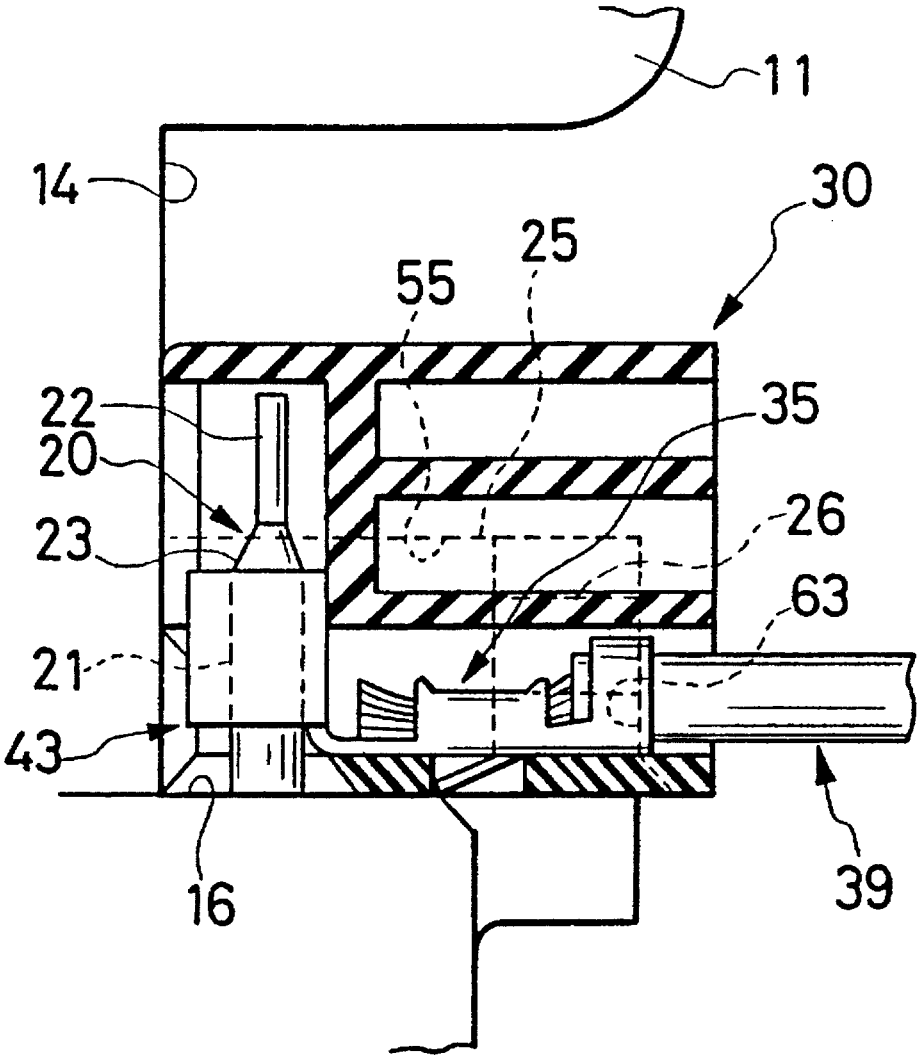
FIG. 6 is a vertical cross-sectional view showing the female connector completely fit along the axis of the round stem of the male terminal.

The fitting groove 55 receives the upper end portion of the guide plate 25 through the front opening 56. The fitting groove 55 then allows the female connector 30 to be pushed toward the abutment wall 14 with the bottom surface of the female connector 30 held in sliding contact with the sliding surfaces 27 of the limitation portions 26, as shown in FIG. 4. After the female connector 30 abuts the abutment wall 14, the fitting groove 55 then permits the female connector 30 to be moved toward the bottom surface 16 of the male connector 15, with the guide plate 25 being inserted upwardly into the fitting groove 55, as shown in FIG. 6.

The vertical receiving portion 53 of each terminal receiving chamber 51 is provided with a terminal insertion port 59. The round stem 20 of the male terminal 19 is adapted to be inserted into the vertical receiving portion 53 through the terminal insertion port 59. Further, two insertion grooves 60 are formed in the front surface of the housing 31. Each insertion groove 60 extends to the associated vertical receiving portion 53 and terminal insertion port 59. The round stem 20 of the male terminal 19 can be inserted into the insertion groove 60 from the front side of the housing 31. Further, tapering guide surfaces 61 are formed on opposite side edges of the insertion groove 60 and terminal insertion port 59 to assist in aligning of the male connector 13 and female connector 30. When the female connector 30 is held against the abutment wall 14 as shown in FIG. 5, the axis of the round stem 20 is positioned at a central portion of the terminal insertion port 59.

Vertical guide grooves 63 are formed in inner surfaces of the fitting groove 55 in the female connector 30 for receiving and guiding the limitation portions 26. The vertical guide grooves 63 are in vertical registry with the limitation portions 26 when the front surface of the female connector 30 is held against the abutment surface 14. Front and rear surfaces of the guide groove 63 are spaced from each other so the limitation portion 26 can snugly fit in the guide groove 63. The front and rear surfaces of the limitation portions 26 can be brought into intimate contact with the front and rear surfaces of the guide groove 63. Therefore, during the movement of the female connector 30 from the position shown in FIG. 5 toward the bottom surface 16 of the male connector 15, the female connector 30 will not misalign. Further, tapering guide surfaces 64 are also formed at lower edges of the guide groove 63 to assist in the movement of the female connector 30 on the male connector 15.

The method of connecting the male connector 15 to the female connector 30 will be described with reference to FIGS. 4–9. First, the upper end portion of the guide plate 25 of the male connector 15 is inserted into the fitting groove 55 through the front opening 56. Thus, the front end portion of the bottom surface of the female connector 30 is placed on the sliding surfaces 27 of the limitation portions 26, as shown in FIG. 4. Next, if the female connector 30 is slightly askew or misaligned, the tapering surfaces 57 at the front end of the fitting groove 55 contact with the guide plate 25 when the female connector 30 is moved toward the male connector 15. The female connector 30 is then moved into an aligned orientation with respect to the male connector 15 and inserted thereon by pushing the female connector 30 toward the abutment wall 14, in the direction of arrow A. The female connector 30 then has its bottom surface urged against the sliding surfaces 27 of the limitation portions 26. The female connector 30 can be pushed parallel to the bottom surface 16 of the male connector 15 without requiring wiggling or shaking.

When the female connector 30 approaches the abutment wall 14, the round stem 20 of each male terminal 19 is inserted through the insertion groove 60. The small diameter portion 22 of the round stem 20 urges the two holding plate portions 46 of the connection portion 43 apart. The round stem 20 fits inside the insertion groove 47. Even if there is misalignment between the round stem 20 and the connection portion 43 of the female terminal 35, the small diameter portion 22 of the round stem 20 will be in contact with the guide plate portions 48 and will be guided, so the small diameter portion 22 positively fits in the insertion groove 47. Thus, the female and male terminals 35 and 19 are properly positioned with respect to each other.

Figure 8:
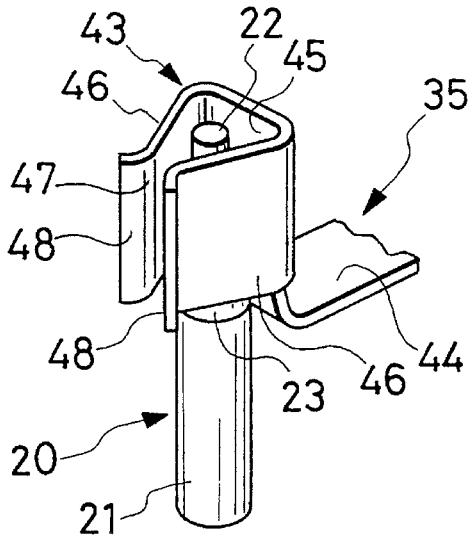
FIG. 8 is an enlarged perspective view showing the round stem after passing through an insertion groove.
Figure 9:
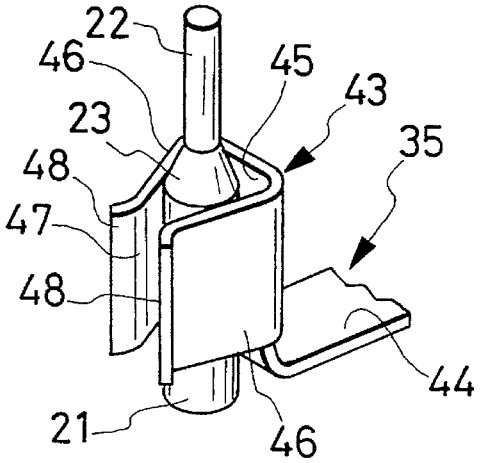
FIG. 9 is an enlarged perspective view showing a connection portion of the female terminal fit on the round stem.

The female connector 30 continues to be pushed until its front surface contacts the abutment wall 14, as shown in FIG. 5. The small diameter portion 22 of the round stem 20 passes through the insertion groove 47 and is received between the two holding plate portions 46 of the female terminal 35, as shown in FIG. 8. The amount of deformation of the holding plate portions 46 is kept at a minimum. The lower edges of the holding plate portions 46 of the connection portion 43 are positioned just above the tapering portion 23 of the round stem 20 and the limitation portions 26 are disposed just beneath the guide grooves 63.

The female connector 30 is then pushed toward the bottom surface 16 of the male connector 15 in the direction of arrow B (FIG. 5). The guide plate 25 is inserted into the fitting groove 55 and the limitation portions 26 are inserted into the respective guide grooves 63. At this point, even if there is misalignment between the limitation portions 26 and the guide groove 63, the upper edge of each limitation portions 26 engages the tapering surface 64 on the edge of the guide groove 63, so the limitation portions 26 are is inserted into the guide groove 63. The guide groove 63 is formed so its front and rear surfaces can be held in intimate contact with the front and rear surfaces of the limitation portion 26, respectively. Therefore, the female connector 30 can be pushed straight toward the bottom surface 16 of the male connector 15 without requiring a wiggling or shaking to connect.

As the female connector 30 is pushed, the holding plate portions 46 of each female terminal 35 are gradually urged away from each other by the tapering portion 23 of the round stem 20. When the female connector 30 is positioned against the bottom surface 16 of the male connector 15, the holding plate portions 46 engage the outer periphery of the large diameter portion 21 of the round stem 20 and resiliently hold the large diameter portion 21. Therefore, the female and male terminals 35 and 19 are therefore electrically connected together.

As described above, since the female and male terminals 35 and 19 are able to correct their position with respect to each other, the alignment of the connector housings does not have to be exact. Therefore, the manufacture of the housings and the attachment of the terminals to the housings can have increased tolerances, the costs associated can be reduced and the efficiency of the operation can be enhanced.

Further, the female connector 30 as described above is fit onto the guide plate 25 and the male connector 15 in an "L" shaped path. Therefore, only if a lateral space capable of receiving the female connector 30 is provided in front of the stems 20, the female and male connectors 30 and 15 can be fit together.

The present invention is not limited to the above described embodiment as shown in the drawings. Other modifications can be made without departing from the scope of the invention. For example, although the connection portion of the female terminal is described with a triangular horizontal cross-section, it may have any other suitable shape, as long as the large diameter portion of the round stem can be resiliently fit in the connection portion. Also, although the connection portion of the male terminal is described with a round stem, the connection portion may be formed as a tab or other suitable construction, in which case distal end portion has a reduced thickness. Further, the female connector may be provided on a housing connected to the motor and connected to a male connector, which is moved with respect to the female connector.

Moreover, the present invention can be applied, not only to the connector for direct connection to the motor, but to other connectors in which female and male connectors receive their respective terminals and are fit together.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit of the scope of the invention as defined in the following claims.

What is claimed is:

1. A connector assembly comprising:

male and female housings;

at least one male terminal and at least one female terminal mounted on the male and female housings, respectively;

the at least one male terminal having a distal end portion narrower than a proximal end portion thereof;

the at least one female terminal comprising:

a connection portion that resiliently fits on an outer periphery of the proximal end portion of the at least one male terminal, an insertion groove formed in a side of the connection portion, the insertion groove being adapted to temporarily hold the distal end portion of the at least one male terminal and allowing the distal end portion to pass therethrough into the connection portion, and guide portions that guide the distal end portion of the at least one male terminal into the insertion groove, the guide portions being formed respectively on opposite side edges of the insertion groove;

wherein the at least one female terminal is connected to the at least one male terminal by inserting the at least one female terminal in a direction intersecting a longitudinal axis of the at least one male terminal, with the distal end portion of the at least one male terminal being passed through the insertion groove, and the at least one female terminal being inserted in a direction along the longitudinal axis of the at least one male terminal.

2. A connector assembly according to claim 1, wherein the at least one male terminal is generally formed in the shape of a round stem, and the distal end portion of the at least one male terminal has a smaller diameter than other portions of the at least one male terminal.

3. A connector assembly according to claim 1, wherein the at least one male terminal and the at least one female terminal are formed of metal.

4. A connector assembly comprising:

a male housing having at least one male terminal, the at least one male terminal having a proximal end and a distal end that is narrower than the proximal end;

a female housing engageable with the male housing, the female housing including at least one female terminal, the at least one female terminal being electrically engageable with the at least one male terminal;

a first structure capable of guiding the at least one female terminal initially in a first direction into engagement with the distal end of the at least one male terminal; and a second structure capable of guiding the at least one female terminal in a second direction that is different than the first direction axially along the at least one male terminal until the at least one female terminal engages the proximal end.

5. A connector assembly according to claim 4, wherein the at least one male terminal includes a tapered portion between the distal end portion and the proximal end portion.

6. A connector assembly according to claim 4, wherein the at least one female terminal includes a bottom plate connected to one side of the connection portion, the bottom plate including a barrel portion for connection to an electrical wire.

7. A connector assembly according to claim 4, wherein the at least one female terminal further includes a portion for fixedly connecting the at least one female terminal to the female housing.

8. A connector assembly according to claim 4, wherein the female housing is a two-piece housing, each piece of the female housing being connectable together to hold the at least one female terminal.

9. A connector assembly according to claim 4, wherein the at least one female terminal comprises two female terminals that are formed from metal.

10. A connector assembly according to claim 4, wherein the direction intersecting the longitudinal axis and the direction along the longitudinal axis are generally perpendicular.

11. A connector assembly according to claim 4, wherein the at least one female terminal comprises:

a connection portion that resiliently fits on an outer periphery of the proximal end portion of the at least one male terminal;

an insertion groove being formed in a side of the connection portion, the insertion groove being adapted to hold the distal end portion of the at least one male terminal and allowing the distal end portion to pass therethrough into the connection portion; and guide portions that guide the distal end portion of the at least one male terminal into the insertion groove, the guide portions being formed respectively on opposite side edges of the insertion groove, wherein the connection portion, the insertion groove and the guide portions comprise the first and second structures.

12. A connector assembly according to claim 11, wherein the connection portion of the at least one female terminal has a generally triangular shape with an open interior.

13. A connector assembly according to claim 11, wherein the insertion groove is located at a corner of the connection portion.

14. A connector assembly according to claim 11, wherein the guide portions open outwardly to guide the distal end portion of the at least one male terminal hold the at least one female terminal.

15. A connector assembly according to claim 4, wherein the first and second structures include a fitting groove on the female housing and a guide plate on the male housing, the guide plate being insertable into the fitting groove.

16. A connector assembly according to claim 15, wherein the fitting groove includes tapered guide surfaces to guide and align the guide plate into the fitting groove.

17. A connector assembly according to claim 15, wherein the guide plate includes at least one limitation portion and the fitting groove includes vertical guide grooves formed on inner surfaces of the fitting groove, wherein the at least one limitation portion is received in and guided by a respective one of the vertical guide grooves.

18. A connector assembly according to claim 4, wherein the at least one male terminal comprises two male terminals that are formed from metal.

19. A connector assembly according to claim 18, wherein the male housing includes a guide plate, each of the two male terminals being disposed on a respective side of the guide plate.

20. A connector assembly according to claim 18, wherein the female housing includes a fitting groove, each of the two female terminals being disposed on a respective side of the fitting groove.

21. A method of connecting a male housing to a female housing, the male housing having at least one male terminal having a proximal end and a distal end that is narrower than the proximal end, the female housing engageable with the male housing and including at least one female terminal electrically engageable with the at least one male terminal, the method comprising:

(a) guiding the at least one female terminal initially in a first direction into engagement with the distal end of the at least one male terminal; and (b) guiding the at least one female terminal in a second direction that intersects the first direction axially along the at least one male terminal until the at least one female terminal engages the proximal end.

22. A method according to claim 21, wherein the first direction and the second direction define a generally L-shaped insertion path.

23. The method according to claim 21, wherein the at least one female terminal includes a connecting portion, an insertion groove at a side of the connection portion, and guide portions formed on opposite side edges of the insertion groove, and wherein the method further includes:

guiding the distal end portion of the at least one male terminal into the insertion groove;

temporarily holding the distal end portion of the at least one male terminal in an insertion portion of the at least one female terminal; and resiliently fitting an outer periphery of the proximal end portion of the at least one male terminal in the connecting portion.

24. A method according to claim 23, wherein the female housing includes a fitting groove and the male housing includes a guide plate, and wherein the method further comprises moving the guide plate into the fitting groove.

25. A method according to claim 24, wherein the fitting groove includes tapered guide surface, and wherein the method further comprises aligning the guide plate into the fitting groove.

* * * * *